United States Patent [19]

Norden, Jr.

[11] Patent Number: 5,010,747

[45] Date of Patent: Apr. 30, 1991

[54] SECUR A DOOR POLICE LOCK

[76] Inventor: H. Peter Norden, Jr., 3 Crest Hill Pl., Smithtown, N.Y. 11787

[21] Appl. No.: 475,257

[22] Filed: Feb. 5, 1990

[51] Int. Cl.[5] ..... E05B 65/00

[52] U.S. Cl. ..... 70/94; 70/71; 292/259

[58] Field of Search ..... 70/94, 95, 91, 130, 70/135, 69–71; 292/259 R, 262, 338, 339, DIG. 46, 285, 44, 54

[56] References Cited

U.S. PATENT DOCUMENTS

| | | | |
|---|---|---|---|
| 588,237 | 8/1897 | Parker | 70/71 |
| 594,759 | 11/1897 | Schnurr | 70/71 X |
| 844,456 | 2/1907 | Mendel | 70/71 |
| 977,184 | 11/1910 | Fuchs | 70/94 |
| 981,843 | 1/1911 | Davis | 70/71 |
| 1,274,181 | 7/1918 | Meyers | 70/94 X |
| 3,527,068 | 9/1970 | Gervis et al. | 70/94 |
| 3,792,885 | 2/1974 | Giardina et al. | 292/259 X |
| 3,821,884 | 7/1974 | Walsh | 292/259 X |
| 4,547,006 | 10/1985 | Castanier | 70/71 X |
| 4,796,445 | 1/1989 | Norden, Jr. | 70/94 |

FOREIGN PATENT DOCUMENTS

| | | | |
|---|---|---|---|
| 2029947 | 12/1971 | Fed. Rep. of Germany | 70/69 |
| 2423608 | 12/1979 | France | 70/69 |

*Primary Examiner*—Gary L. Smith
*Assistant Examiner*—Suzanne L. Dino
*Attorney, Agent, or Firm*—Leonard Belkin

[57] ABSTRACT

A door locking mechanism for a door which is mounted on the inside of a door which can be hung to open either inwardly or outwardly. The mechanism consists of a lever arm pivotally mounted connected at its ends to extended members which at their opposite ends are connected to lock bolts. The frame supporting the door is equipped with members to receive the bolts when the door is locked. The outside of the door is provided with a lock to move the bolts out or in to lock or unlock the door. The inside of the door is provided with a knob to effect the movement of the bolts.

6 Claims, 4 Drawing Sheets

FIG. 4
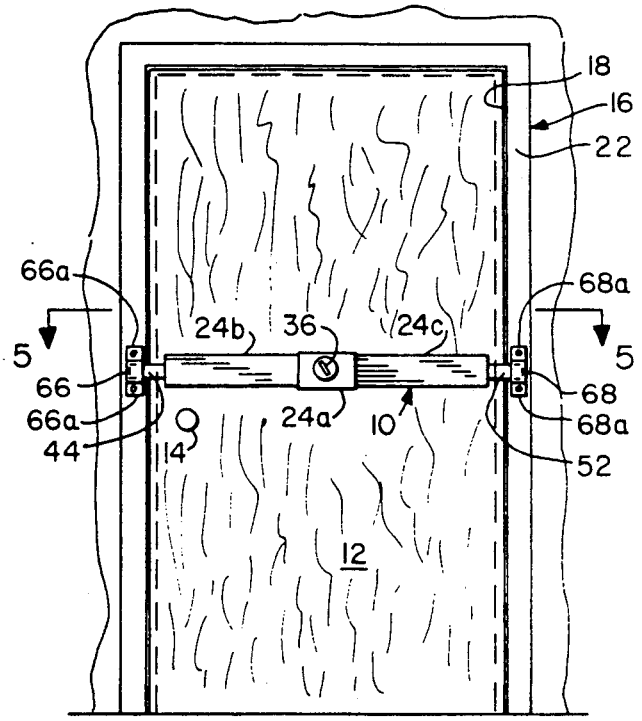
FIG. 6
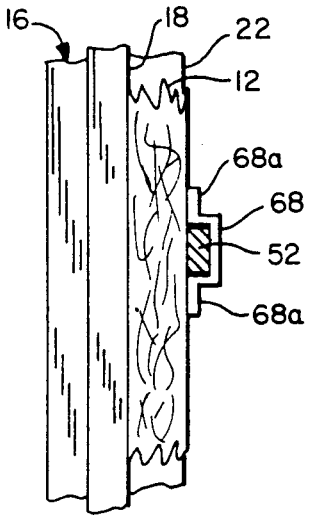
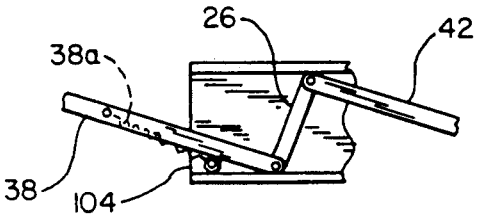
FIG. 8a
FIG. 5
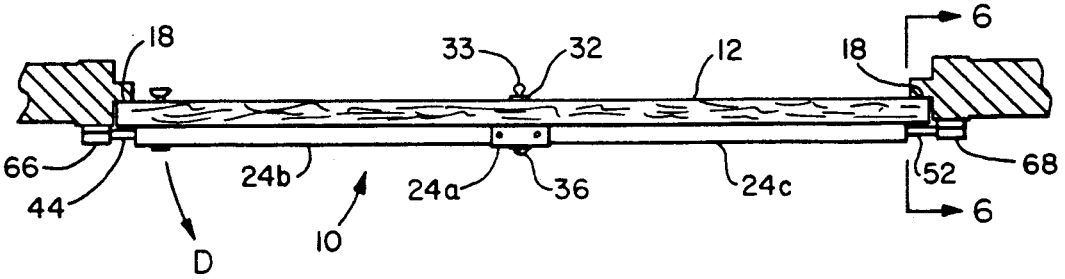

SECUR A DOOR POLICE LOCK

BACKGROUND OF THE INVENTION

This invention relates to a door locking mechanism and more particularly to a door locking mechanism for use on either an inwardly or outwardly opening door which can be locked and unlocked from the outside.

Commercial establishments and many residential buildings in urban areas require door locking mechanisms with improved ability to withstand attempts at unlawful entry.

In my U.S. Pat. No. 4,796,445 I disclose a door locking mechanism designed to be used on outswinging doors being capable of being locked in both the open and unclosed positions, an important aspect for a door being used to meet fire regulations where the public will or may congregate such as public halls, restaurants, theaters, and the like.

For commercial and residential buildings not designed to meet the fire regulations for crowds of people, there is the need for a door locking mechanism economical in construction with the ability to secure a door on both sides to improve the capability to resist breaking and entering and also to permit entry from the outside. Also, the door locking mechanism should be trouble free in operation and capable of use on both inwardly and outwardly opening doors.

In a police action door lock marketed by Vigilante Burglar Bars. Inc., there is employed a lever operated double throw door locking mechanism which can only be used in outwardly swinging doors and can not be locked and unlocked from the outside. In addition, the pivoting arrangement requires that the angle of the bars being extended varies over their range of movement thereby rendering it difficult if not impossible to make a tight fit on the door jamb if a female receiving member is employed.

In the Fox Police Double Bolt Lock, a worm and gear arrangement is employed in which the spindle and tailpiece may become locked in position and thus is not trouble free. Another problem with this construction is the cost of a worm and gear arrangement. It is also not clear whether the arrangement can be conveniently employed with an inwardly opening door.

SUMMARY OF THE INVENTION

The present invention is designed to fulfill the need described above by providing a door locking mechanism which locks both side edges of the door simultaneously, can be used with both inwardly and outwardly opening doors, is economical in construction, trouble free in operation, and can be locked and unlocked from outside the room or building where it is being employed.

A preferred embodiment of this invention comprises a lever operated double throw mechanism consisting of a member pivoted at its center mounted in the middle of the door having attached to each end one end of an arm extending to opposite sides of the door. The far end of each arm is pivotally attached to one end of a slide which is mounted to slide horizontally to engage a female member mounted on the door jamb.

The pivoted member is joined to a lock penetrating the door so that the proper key can, be employed to actuate the lever mechanism from outside of the door. On the inside of the door the mechanism is actuated by a knob. The assembly with the knob protruding may be enclosed in a housing.

The arrangement just described is simple in construction and entirely trouble free in operation so that no special instructions are required for its use. It can be readily mounted on either an inwardly or outwardly opening door and will securely lock both side edges of the door.

It is thus a principal object of this invention to provide an improved door locking mechanism which is reliable, inexpensive to manufacture and maintain, and useful on both inwardly and outwardly closing doors.

Other objects and advantages of this invention will hereinafter become obvious from the following description of a preferred embodiment of this invention.

BRIEF DESCRIPTION OF THE DRAWINGS

FIG. 4 is a front, elevation view of the door locking mechanism shown in FIGS. 1-3 operatively installed on the inside of an inwardly swinging door.

FIG. 5 is a section view taken along 5—5 of FIG. 4.

FIG. 6 is a section view taken along 6—6 of FIG. 5.

FIG. 8*a* is a detail showing lever arm in the locked position.

DESCRIPTION OF THE PREFERRED EMBODIMENTS

Figure 1:
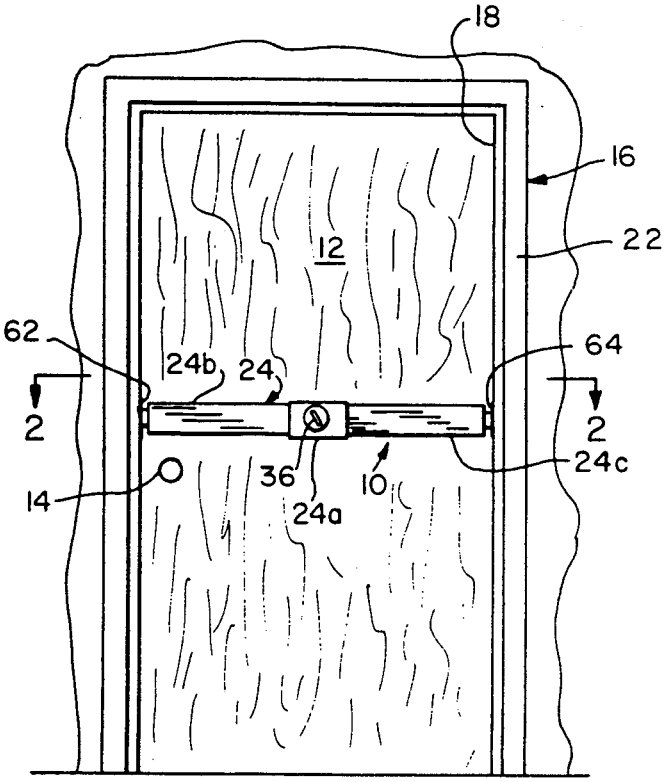
FIG. 1 is a front, elevation view showing a preferred embodiment of the door locking mechanism of the present invention operatively installed on the inside of an outwardly swinging door.
Figure 3:
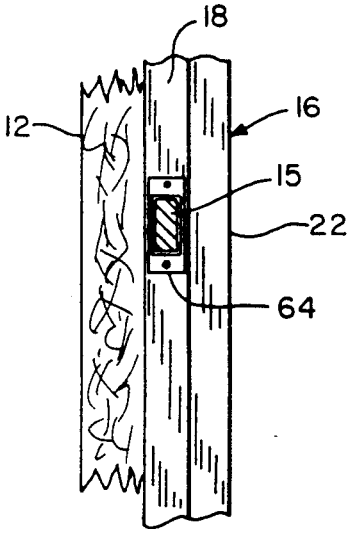
FIG. 3 is a section view taken along 3—3 of FIG. 2.
Figure 2:
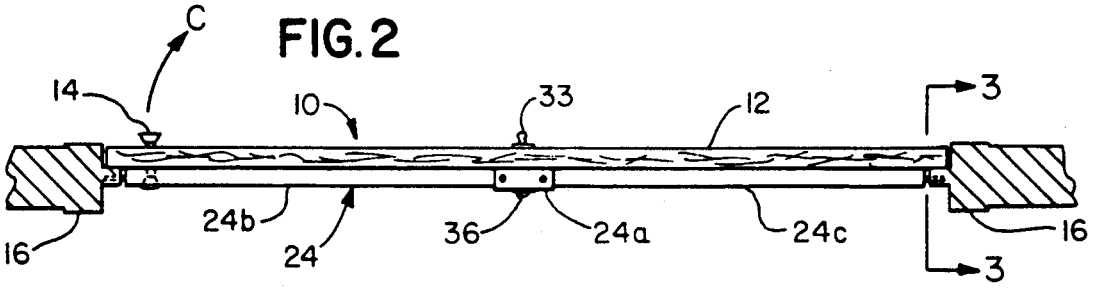
FIG. 2 is a section view taken along 2—2 of FIG. 1.

Referring to FIGS. 1-3, there is shown a door locking mechanism 10 incorporating the principles of this invention mounted on the inside of an outswinging door 12 with a conventional door knob 14 hung in conventional fashion over the opening formed by a door frame 16. Conventional hinges (not shown) are employed to mount the door. Frame 16 is provided with a protruding inside door jam 18 along the sides and top of frame 16 against which door 12 closes typical of conventional construction. The exterior, outwardly facing surface 22 of door frame 16 is herein referred to as the outside door jam.

Figure 7:
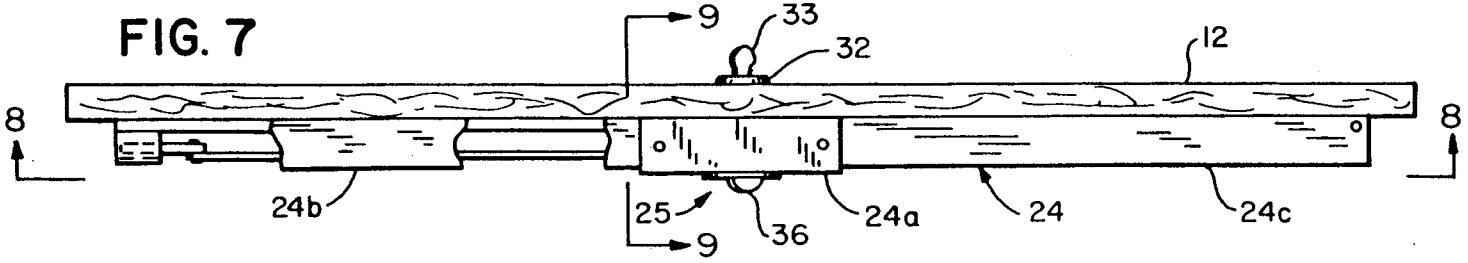
FIG. 7 is a top, plan view of a door having the door locking mechanism of FIGS. 1-6 mounted thereon with a portion of the housing broken away.
Figure 8:
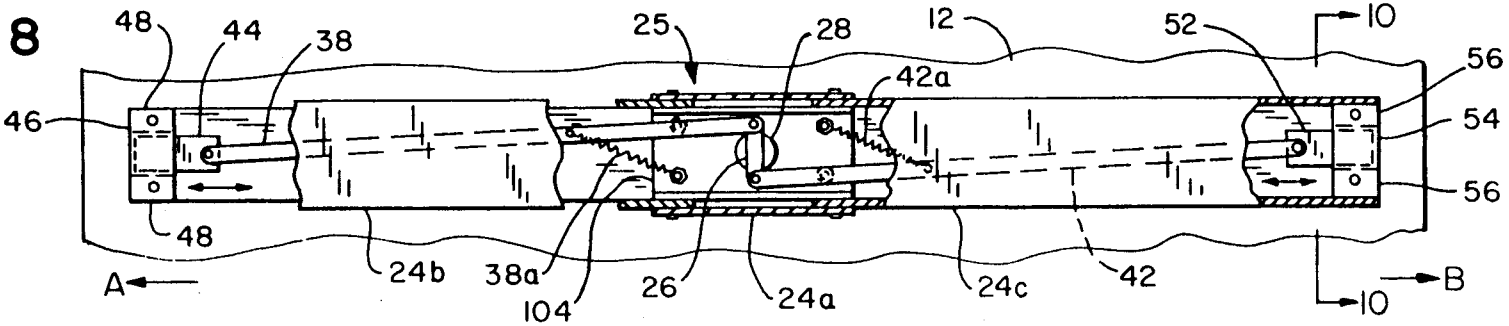
FIG. 8 is a view taken along 8-8 of FIG. 7.
Figure 9:
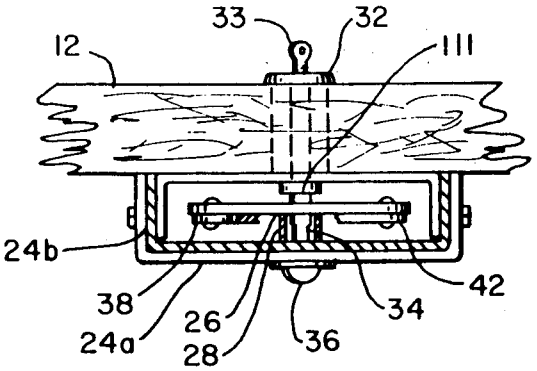
FIG. 9 is a section view taken along 9—9 of FIG. 7.
Figure 10:
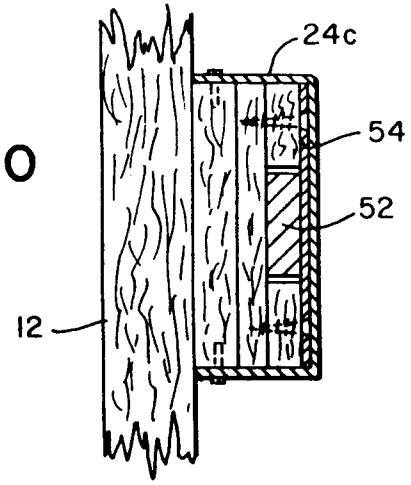
FIG. 10 is a section view taken along 10—10 of FIG. 8.

Door locking mechanism 10 consists of a housing 24 made up of by a control cover 24*a* and left and right covers 24*b* and 24*c*, respectively enclosing the operating elements of mechanism 10. These elements, comprising a lock assembly 25, as seen in FIGS. 7-9, consist of a lever arm 26 pivotally mounted on, and for rotation with, a barrel 28. The latter is supported by a flat member 34 which is connected at one end on the outside of door 12 to a rim cylinder lock 32 operated by a key 33. Knob 36 on the inside of door 12 is connected through cover 24*a* to barrel 28 on which is mounted lever arm 26 which therefore can be rotated by knob 36. Lever arm 26 can also be rotated in the manner to be described below by the use of key 33 on the outside of door 12. The manner in which this type of operation is made possible will be described below.

At one end of lever arm 26 is pivotally mounted one end of a floating extended member 38 while at the other end of arm 26 is mounted one end of a floating extended member 42.

The other end of member 38 is pivotally attached to one end of a slidable bolt 44 which is constrained within an enclosure 46 which permits the movement of bolt 44 as indicated by the double headed arrow. Enclosure 46 is provided with a pair of flanges 48 for bolting to door 12.

In a similar fashion, the other end of member 42 is pivotally attached to one end of a slidable bolt 52 which is constrained within an enclosure 54 having a pair of flanges 56 permitting the slideable movement of bolt 52 as shown by the double headed arrow.

Springs 38*a* and 42*a* bias members 38 and 42, respectively, in the unlocked position as shown in FIG. 8 or in the locked position as illustrated in FIG. 8*a*.

When lever arm 26 is rotated counterclockwise (FIG. 8) by either key 33 in lock 32 or by knob 36, bolts 46 and 52 are moved outwardly as shown by arrows A and B. Bolts 46 and 52 are retracted by the clockwise movement of lever arm 26 also requiring the use of key 33 on the outside of the door or knob 36 on the inside of door 12.

It will be seen from FIGS. 1–3 that door 12 is hung to open outwardly as shown by arrow C in FIG. 2. When door 12 is shut, in order to lock the door, bolts 44 and 52 when extended outwardly pass through openings in plates 62 and 64 mounted on the inwardly facing surfaces 18 of door jamb 16 as best seen in FIGS. 1 and 3.

For the application of mechanism 10 on door 12 when it is hung to open inwardly, reference is made to FIGS. 4–6, where it is seen that door 12 opens in the direction shown by arrow D. In this situation, when door 12 is closed as illustrated, it rests on the surface of door jamb 18 facing toward the inside of, rather than on the surface of door jamb 18 facing the outside of, the room or building.

In this situation, surface 22 is provided with a pair of retainers 66 and 68 provided with flanges 66*a* and 68*a*, respectively, to permit mounting on surface 22 as illustrated. When bolts 44 and 52 are extended to lock door 12 in the manner described above, and as shown in FIGS. 46, they extend into retainers 66 and 68 thereby preventing door 12 from being opened. Again, as previously described, the use of key 33 to unlock lock 32 and rotate the mechanism to retract bolts 44 and 52 from within retainers 66 and 68, respectively, from the outside of door 12 or the rotation of knob 36 on the inside of door 12 will permit the door 12 to be opened.

Figure 11:
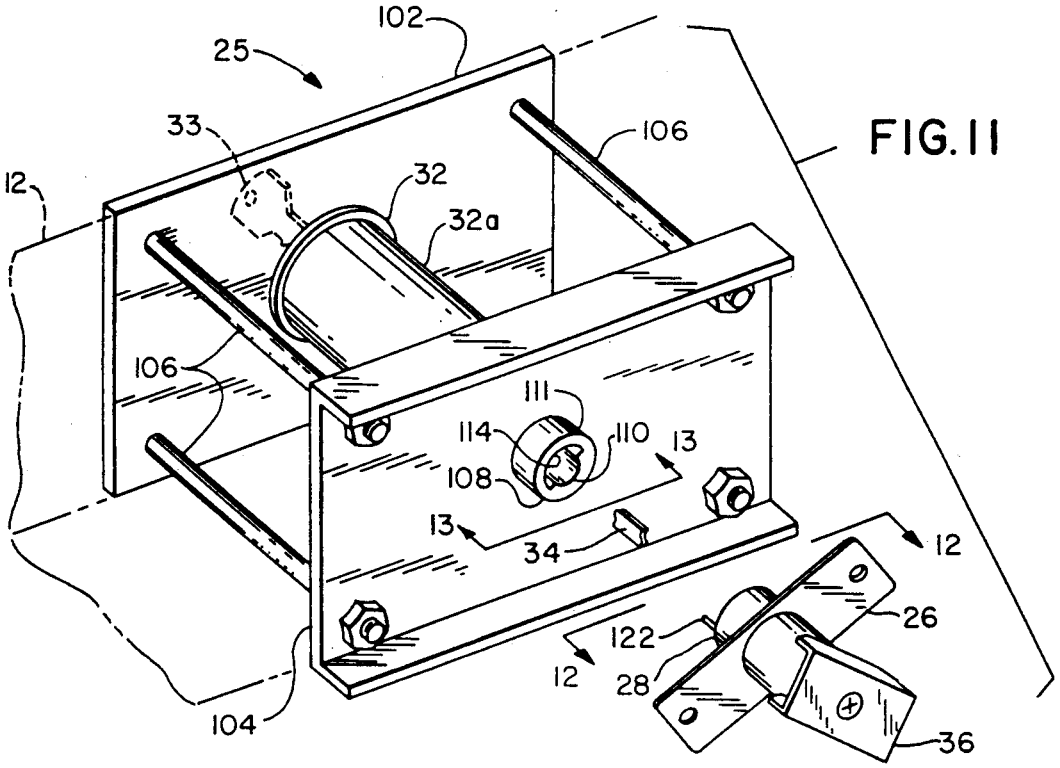
FIG. 11 is an isometric view of the lock assembly.
Figure 12:
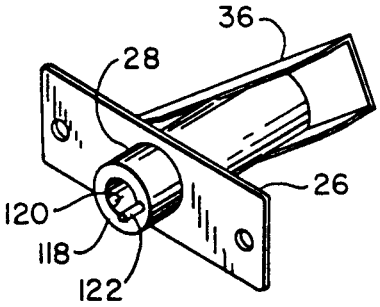
FIG. 12 is a view along 12—12 of FIG. 11.
Figure 13:
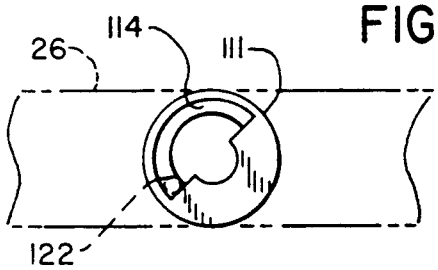
FIG. 13 is a left side elevation view of FIG. 12.

For the details of how key 33 and knob 36 move so that knob 36 will not rotate the insides of lock 33 when lever arm 26 is turned by knob 36 reference is made to FIGS. 11–13.

Lock assembly 25 consists of plate 102 mounted on the outside of door 12 shown in phantom and a U-shaped plate 104 (to support control cover 25*a*, not shown) mounted on the inside of door 12, plates 102 and 104 being interconnected by bolts 106. Lock 32 terminates in a cylinder 111 at 108 on the inside of door 12 with a circular opening 110 to permit flat member 34 to extend out and into barrel 28, and to be rotated by key 33. A half-moon shaped grooved 114 is formed as illustrated for a purpose now to be described.

Knob 36 and lever arm 26 are integrally mounted on barrel 28. As seen in FIG. 12 barrel 28 terminates in a flat face 118 with a circular opening 120 to accomodate flat member 34 to permit the latter to rotate freely while supporting barrel 28. A pin 122 extends from face 118 to ride in half-moon shaped groove 114 in cylinder 111.

For the operation of lock assembly 25 just described, FIG. 13 illustrates cylinder 111 and pin 122 (shown in phantom) in place with mechanism 10 in its unlocked position, that is, lever arm 26 in its substantially vertical position (as seen in FIG. 8). Knob 36 (not shown) is rotated counterclockwise causing lever arm 26 (shown in phantom) to rotate counterclockwise to cause slidable bolts 44 and 52 to move outwardly and lock the door. Pin 122 rides in half-moon shaped groove 114 thereby not causing rotation of cylinder 111. In a similar fashion, knob 36 can be rotated clockwise to unlock mechanism 10.

To use key 33 on the outside of door 12, the key is inserted and rotated clockwise causing cylinder 111 to push pin 122 and cause lever arm 26 to rotate to lock door 12, and then key 33 is turned back to its original position so it can be removed, pin 122 riding freely in groove 114. Key 33 can be rotated further in a counter clockwise direction to unlock mechanism 10. In a rim cylinder lock the key can be inserted and removed only in one position. This feature of being able to use knob 36 without adversely affecting the position of the tumblers within lock 33 is thus important.

Figure 14:
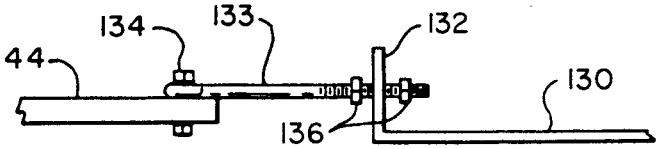
FIG. 14 is a detail of a modified arrangement for connecting a floating extend member to a slidable bolt.

In order to permit the lengths of floating extended members 38 and 42 to be adjusted to permit accurate positioning of slidable bolts 44 and 52, an arrangement such as that shown in FIG. 14 may be employed. Floating extended member 130 corresponding to extended member 38 in FIGS. 1–13 may be provided with a leg 132 so that a threaded element 133 may be employed to connect leg 132 to slidable bolt 44 using a bolt 134. A pair of nuts 136 and 138 would be tightened against leg 132. By moving nuts 136 and 138 the effective length of member 130 may be altered. In a similar fashion the floating extended member connected to slidable bolt 52 would be constructed in the same manner.

It will be seen that the apparatus as described is simple and economic in construction, effective and reliable in use because there is little or nothing which is likely to prevent its operation, and can be used on either an outwardly or inwardly opening door.

While only certain preferred embodiments of this invention have been described, it is understood that many variations are possible without departing from the principles of this invention as defined in the claims which follow.

What is claimed is:

1. In combination with an inwardly or outwardly opening door mounted in the opening of a room or a building having a frame forming said opening in which said door is mounted, said frame including door jamb means having a portion thereof extending inwardly so that said door when shut is flush against one surface of said portion, door locking means comprising a lever arm pivotally mounted at its center on the inner surface of said door, means for supporting for slidable movement in a straight line a first bolt adjacent one edge of said door, means for supporting for slidable movement in a straight line a second bolt adjacent an opposite edge of said door, both of the aforesaid straight lines being aligned with each other so that the aforesaid bolts slide in opposite directions along the same straight line without any rotation with respect to said straight line, connecting means in response to the rotation of said lever arm in one direction to cause said bolts to slide away from each other, and in response to the rotation of said lever arm in the opposite direction to cause said bolts to move toward each other, lock means on the outside of said door passing through said door and connected to said lever arm to permit the use of a key to rotate said lever arm, knob means on the inside of said door connected to said lever arm through pin and cylinder means to permit the rotation of said lever arm by said knob means without causing movement within said lock means to permit rotation of said lever arm to open said door when said lock is in the locked position without disengaging said knob means from said lock, and retainer means mounted on said frame to lock said door when said lever arm is rotated in said one direction causing said bolts to engage said retainer means and to unlock said door when said lever arm is rotated in the opposite direction causing said bolts to become disengaged from said retainer means, said connecting means comprising a first floating link connected pivotally at one end to said first bolt and pivotally at the other end to one end of said lever arm and a second floating link connected pivotally at one end to said second bolt and pivotally at the other end to the other end of said lever arm, and spring means to bias said first and second floating links in both the locking and unlocking positions of said bolts, said spring means comprising a spring for each of said floating links, one end of each spring connected to a floating link, and the other end of each spring connected to said door.

2. The combination of claim 1 wherein said retainer means comprises plates on opposite sides of said door mounted on said door jamb facing toward said door when said door is mounted to open outwardly, said plates having openings to accomodate said bolts, said door being locked when said bolts are extended to pass through said openings in said plates.

3. The combination of claim 1 wherein said retainer means comprises members on opposite sides of said door mounted on said door jamb facing toward the inside of said room or building when said door is mounted to open inwardly, said members having openings to receive said bolts, said door being locked when said bolts are extended to pass into said openings in said members.

4. The combination of claim 1 in which each of said supporting means for said first and second bolts comprises a fixed enclosure mounted on said door through which its bolt slides to insure that said bolts move in said straight line.

5. The combination of claim 1 having means to adjust the length of said connecting means.

6. The combination of claim 5 in which each said link is connected to its respective bolt using bolt means which is adjustable in length.

* * * * *